United States Patent [19]

Vassalotti et al.

[11] 4,436,694

[45] Mar. 13, 1984

[54] NUCLEAR REACTOR CAVITY DECONTAMINATION MACHINE

[75] Inventors: Michael Vassalotti, New Milford, Conn.; Alvaro Obligado, Waccabuc, N.Y.

[73] Assignee: Automation Industries, Inc., Greenwich, Conn.

[21] Appl. No.: 297,554

[22] Filed: Aug. 31, 1981

[51] Int. Cl.[3] ..... G21C 19/20

[52] U.S. Cl. ..... 376/310; 376/249; 376/262

[58] Field of Search ..... 376/249, 309, 310, 251, 376/262; 15/56, 104.1 C; 239/177

[56] References Cited

U.S. PATENT DOCUMENTS

| | | | |
|---|---|---|---|
| 3,550,177 | 12/1970 | Darr et al. | 15/104.1 C |
| 3,817,348 | 6/1974 | Jones | 15/56 |
| 3,869,088 | 3/1975 | Dykmans | 239/177 |
| 4,131,018 | 12/1978 | Muller et al. | 374/249 |
| 4,311,556 | 1/1982 | Iwamoto et al. | 376/249 |

FOREIGN PATENT DOCUMENTS

| | | | |
|---|---|---|---|
| 51-1893 | 9/1976 | Japan | 376/251 |
| 704676 | 12/1979 | U.S.S.R. | 15/56 |

*Primary Examiner*—Sal Cangialosi
*Attorney, Agent, or Firm*—Francis N. Carten

[57] ABSTRACT

Apparatus is disclosed for decontaminating the wall of a boiling water reactor cavity. A chassis on wheels is rollable on the refueling floor along the cavity curb. A pair of horizontal wheels roll against the curb. A support member extends upwardly and laterally from the chassis to clear the personnel handrail. A mast depends from the support member into the cavity and includes a horizontal reaction wheel bearing against the cavity wall. A vertically positionable carriage is mounted on the mast and carries water spray nozzles directed against the wall.

10 Claims, 3 Drawing Figures

FIG. 2
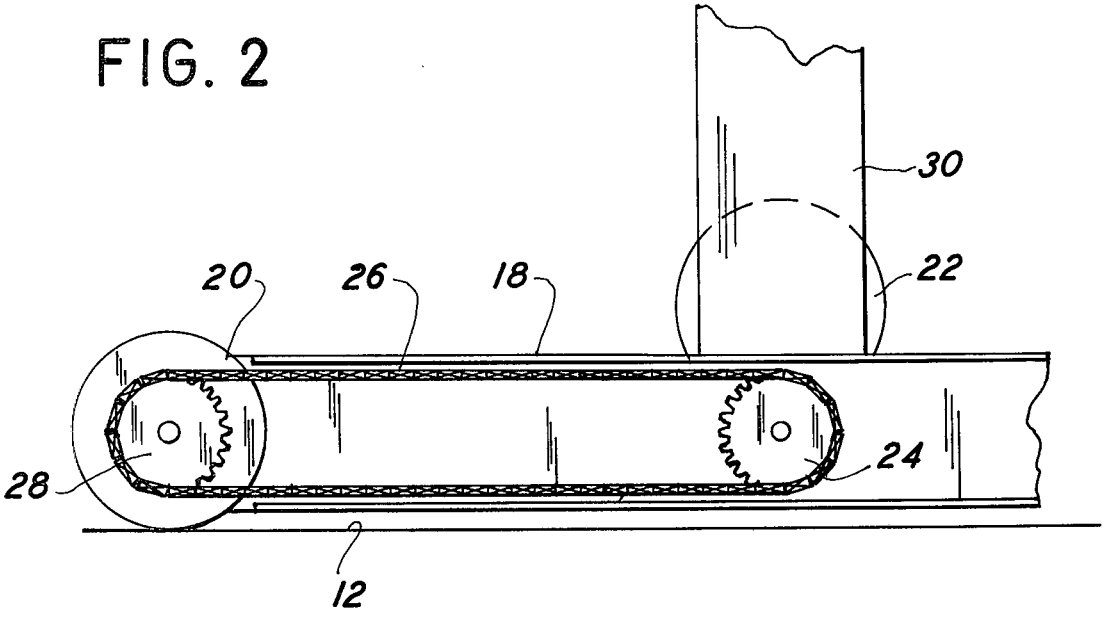
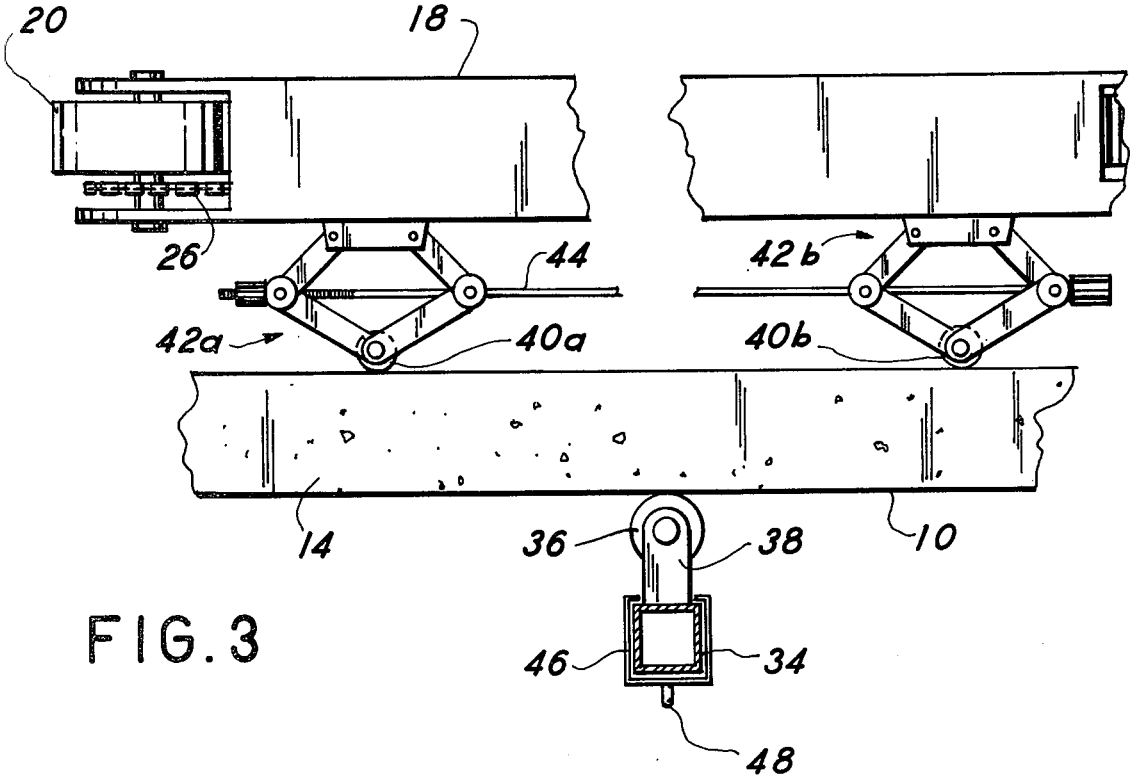
FIG. 3

NUCLEAR REACTOR CAVITY DECONTAMINATION MACHINE

TECHNICAL FIELD

This invention pertains to nuclear reactors and, more particularly, to apparatus for decontaminating the walls of boiling water reactor cavities and storage pits.

BACKGROUND ART

One of the operations which is normally performed during the outage of a nuclear boiling water reactor is the decontamination of the reactor cavity. This is considered to be a "critical path" operation as opposed to a "collateral" operation. In other words, it is an operation which must be performed before the succeeding operation can be undertaken and, thus, adds directly to the length of the shutdown period.

Decontamination of boiling water reactor cavity and storage pit walls is achieved by the spraying of high pressure water on the walls. The manner in which this is conventionally achieved is by lowering a man into the cavity or pit in a container suspended from a crane. He then proceeds to wash down the wall with a high pressure hose. It is desirable to use very high pressure water for this purpose, for example, up to 10,000 psi. However, the high reaction forces acting upon a container at the end of a relatively long cable cause the container and workman to be bounced from side to side. The man, even though wearing protective gear, is exposed to highly contaminated water droplets in a highly radioactive environment. The radioactivity, coupled with the sheer physical stress, makes this a very difficult and undesirable job. Because of the reaction forces, it is usually necessary to reduce the water pressure below its optimum value. As a result, the decontamination period is substantially increased and may be, for example, on the order of 8 hours.

As reactor shutdowns are very costly, it would be highly desirable to shorten the time for decontamination. It would also, of course, be desirable to reduce or eliminate the exposure of personnel to the dangers and stress-inducing features of the conventional decontamination washdown.

DISCLOSURE OF INVENTION

In accordance with the invention, apparatus is provided for decontaminating the inside walls of a nuclear reactor cavity or storage pit in a refueling floor having a raised curb around its periphery. The apparatus comprises a chassis which has wheels in rolling contact with the floor and first and second curb wheels mounted on the chassis in rolling contact with the curb. A support member includes a vertical portion which extends upwardly from the chassis, and a horizontal arm which extends laterally from the top of the vertical portion to overhang the edge of the cavity or pit. An elongated mast depends from the horizontal arm and into the reactor cavity and carries at least one stabilizing wheel for horizontal rolling engagement with the cavity or pit wall. A spray carriage is selectively, vertically positionable along the elongated mast and carries means for spraying decontaminating fluid on the wall.

BRIEF DESCRIPTION OF THE DRAWINGS

FIG. 2 is an enlarged cross-section taken vertically through a portion of the chassis member of FIG. 1; and FIG. 3 is an enlarged, partial top view of the apparatus of the invention illustrating its engagement with the cavity wall and curb.

BEST MODE FOR CARRYING OUT THE INVENTION

Figure 1:
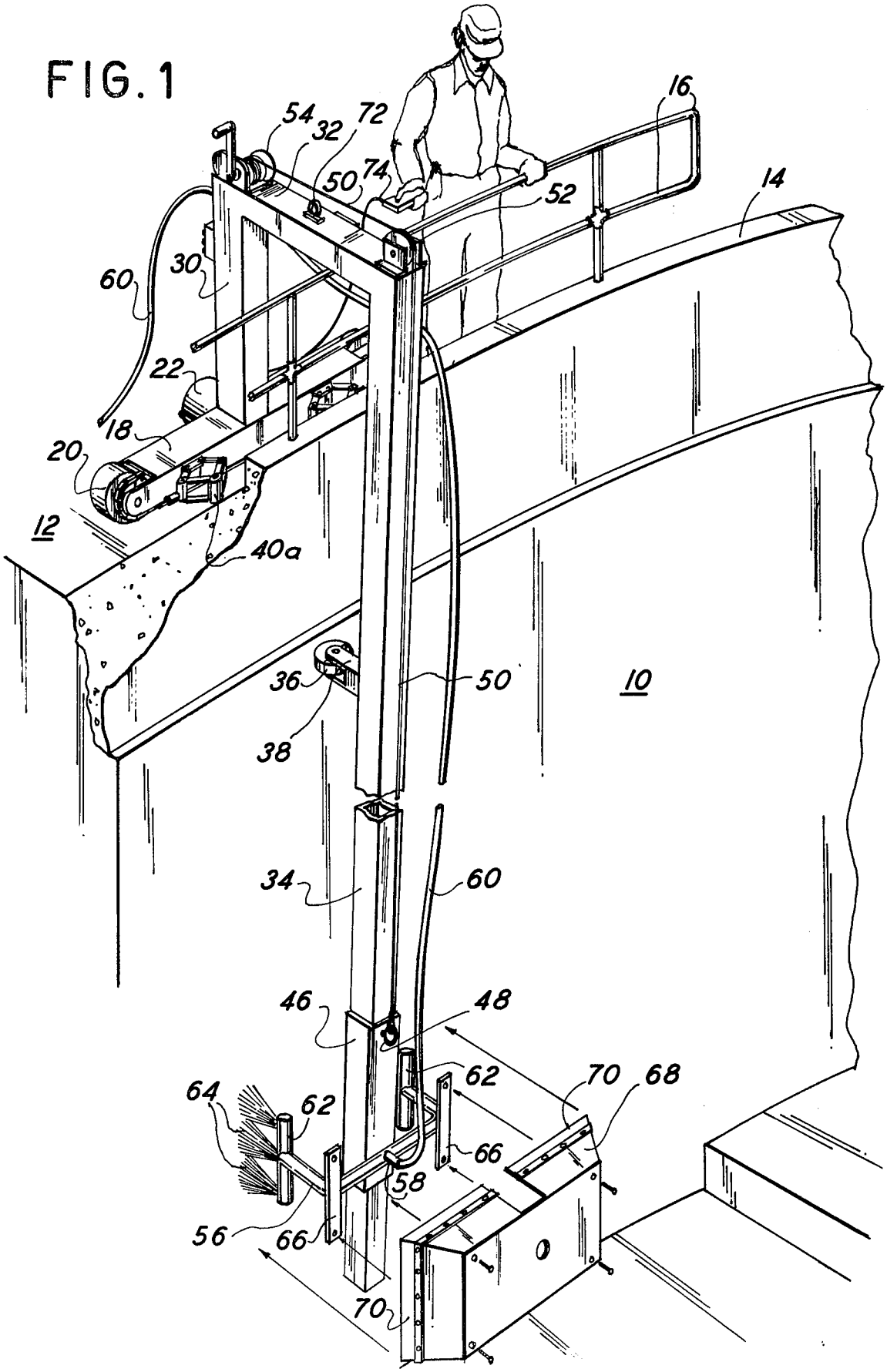
FIG. 1 is a perspective view of the apparatus of this invention positioned in a reactor cavity.

FIG. 1 illustrates apparatus in accordance with this invention positioned in a reactor cavity having an inner wall 10 separated from the refueling floor 12 by a conventional four inch high curb 14 on which are mounted the personnel handrails 16. The apparatus of the invention comprises a chassis 18 which, in the emboidment illustrated, is elongated and of substantially rectangular cross-section. It carries a wheel 20 at each end. In the illustrated embodiment, one of the wheels 20 is driven by a reversible electric motor 22. As shown in FIG. 2, the motor 22 controls a drive sprocket 24 through a suitable gear box (not shown). By means of a chain 26, a driven sprocket 28 drives the wheel 20 to propel chassis 18 along the floor 12.

Extending upwardly from the chassis 18, to clear the handrail 16, is a rectangular, vertical support member 30, from the upper end of which a horizontal arm 32 extends over the cavity. Depending downwardly from the arm 32 and parallel to the cavity wall 10 is an elongated, rectangular mast 34.

The assembly is stabilized relative to the cavity by a three point arrangement comprising a reaction wheel 36 mounted on a bracket 38 on mast 34 to bear against the cavity wall 10 and a pair of curb wheels 40*a, b*. As is shown most clearly in FIG. 3, the wheels 40 are horizontally, adjustably, mounted on the chassis 18 by means of scissor jack assemblies 42*a, b* and are controllable by means of a common adjustment screw 44.

Mounted on the mast 34, for vertical movement therealong, is a spray carriage 46. Carriage 46 is substantially U-shaped in cross section, as shown in FIG. 3, in order to clear the bracket 38 carrying reaction wheel 36. Connected to the upper end of the carriage 46 is an eye 48 to which is connected the end of a cable 50. Cable 50 passes over a sheave 52 mounted at the top of the mast 34 and continues to a hand operated ratchet winch 54.

The carriage 46 carries a U-shaped pipe 56. The arms of the U-shaped pipe point toward the cavity wall 10 and its center carries a hose coupling 58 to which is connected a high pressure water supply hose 60. The other end of the hose 60 is connected to a suitable water supply (not shown). Mounted at the ends of the arms of the U-shaped pipe 56 are a pair of manifolds 62, each of which extends generally vertically and carries a number of nozzles for producing water sprays 64. A suitable mounting frame 66 supports a generally box-shaped shroud 68 having an elastomeric sealing rim 70 for engaging the cavity wall 10.

Completing the apparatus of this invention is a crane hook 72 which is attached to the horizontal arm 32 and an optional remote control and cable 74 for operating motor 22.

OPERATION

When a wall is to be decontaminated, the apparatus of the invention is lifted by means of a crane and the crane hook 72 into the position illustrated in FIG. 1, straddling the curb 14 and the handrail 16. The curb wheels 40 are horizontally adjusted by means of the screw 44 so as to force them against the outer edge of the curb 14. These two wheels, which run along the outer edge of the curb, together with the reaction wheel 36 on the inside wall to be decontaminated, stabilize the apparatus.

To clean the wall, the operator using the winch 54 sets the spray carriage 46 to a position on mast 34 at the top of the wall 10. High pressure water is then supplied through the hose 60 and is sprayed onto the wall surface. The shroud 68 contains splashback and minimizes airborne contamination. The apparatus is then run along the curb 14 by means of the motor 22 and the drive wheel 20, thereby cleaning a horizontal strip of the wall 10. The operator then lowers the spray carriage by means of the hand winch 54 and runs the apparatus back along the curb to clean another strip. This operation is repeated, overlapping each cleaning stroke until the entire wall is cleaned. The manifolds 60 are positioned at a suitable distance from the wall 10 such that they do not interfere with structural members, such as spargers, etc.

In a few installations, the vertical handrail supports are mounted externally of the curb 14 rather than on its top. Under these conditions, the same apparatus may be used but it may be necessary to lay a temporary, or permanent, sheet metal surface over them, paralleling the curb 14, to provide a track for the curb wheels 40.

It will be apparent to those skilled in the art, that a number of variations and modifications may be made in this invention without departing from its spirit and scope. For example, it is not necessary that the unit be self-propelled as it could be pushed by hand. Similarly, the hand winch 54 could be replaced by an automatic drive. Various other modifications may also be made without departing from the spirit and scope of the invention. For example, the shroud 68 could be provided with a vacuum spray collector. Accordingly, the foregoing description is to be construed as illustrative only, rather than limiting. This invention is limited only by the scope of the following claims.

What is claimed is:

1. Apparatus for decontaminating the inside walls of a nuclear reactor cavity in a refueling floor, having a raised curb around its periphery which comprises:

a chassis having wheels in rolling contact with said floor;

first and second curb wheels mounted on said chassis in horizontal rolling contact with said curb;

a support member extending upwardly and laterally from said chassis;

an elongated mast depending from said support member and into the reactor cavity;

at least one reaction wheel carried by said mast for horizontal rolling engagement with the cavity wall;

a carriage vertically positionable along said elongated mast; and means carried by said carriage for spraying decontaminating fluid on said cavity wall.

2. The apparatus of claim 1 wherein said chassis includes a motor connected to drive at least one of said floor contacting wheels.

3. The apparatus of claim 1 wherein said curb wheels include adjustable mounting means for varying the distance between each of said curb wheels and said chassis.

4. The apparatus of claim 3 wherein said mounting means comprises a scissors jack.

5. The apparatus of claim 1 wherein said mast includes means for raising and lowering said carriage.

6. The apparatus of claim 5 wherein said raising and lowering means comprises a cable.

7. The apparatus of claim 5 wherein said spraying means comprises water nozzles.

8. The apparatus of claim 7 wherein said carriage includes a protective shroud surrounding said nozzles.

9. The apparatus of claim 8 wherein said curb wheels include adjustable mounting means for varying the distance between each of said curb wheels and said chassis.

10. The apparatus of claim 9 wherein said chassis includes a motor connected to drive at least one of said floor contacting wheels.

* * * * *